US009464847B2

(12) United States Patent
Maurer et al.

(10) Patent No.: US 9,464,847 B2
(45) Date of Patent: Oct. 11, 2016

(54) SHELL-AND-TUBE HEAT EXCHANGERS WITH FOAM HEAT TRANSFER UNITS

(75) Inventors: Scott M. Maurer, Haymarket, VA (US); Nicholas J. Nagurny, Manassas, VA (US); Michael R. Eller, New Orleans, LA (US); James W. Klett, Knoxville, TN (US)

(73) Assignee: Lockheed Martin Corporation, Bethesda, MD (US)

( * ) Notice: Subject to any disclaimer, the term of this patent is extended or adjusted under 35 U.S.C. 154(b) by 1057 days.

(21) Appl. No.: 13/365,459

(22) Filed: Feb. 3, 2012

(65) Prior Publication Data

US 2012/0199331 A1 Aug. 9, 2012

Related U.S. Application Data

(60) Provisional application No. 61/439,564, filed on Feb. 4, 2011.

(51) Int. Cl.
*F28D 7/16* (2006.01)
*F28D 7/02* (2006.01)
(Continued)

(52) U.S. Cl.
CPC ..... *F28D 7/1607* (2013.01); *F28D 7/024* (2013.01); *F28D 7/1669* (2013.01); *F28F 9/22* (2013.01);
(Continued)

(58) Field of Classification Search
CPC ..... F28D 3/02; F28D 3/04; F28D 7/1607; F28D 7/024; F28D 7/1669; F28F 9/22; F28F 21/02; F28F 13/003; F28F 2009/226; F28F 2275/025; F28F 2275/062
USPC ..... 165/159, 160, 162, 905
See application file for complete search history.

(56) References Cited

U.S. PATENT DOCUMENTS 398,645 A 2/1889 Moore
1,525,094 A * 2/1925 Jones ..... F28F 9/22 165/109.1
(Continued)

FOREIGN PATENT DOCUMENTS

CN 2199467 Y 5/1995
CN 2201284 Y 6/1995
(Continued)

OTHER PUBLICATIONS

Partial International Search for international application No. PCT/US2012/023783, dated Jun. 4, 2012 (2 pages).
(Continued)

*Primary Examiner* — Tho V Duong
*Assistant Examiner* — Raheena Rehman
(74) *Attorney, Agent, or Firm* — Withrow & Terranova, PLLC

(57) ABSTRACT

Shell-and-tube heat exchangers that utilize one or more foam heat transfer units engaged with the tubes to enhance the heat transfer between first and second fluids. The foam of the heat transfer units can be any thermally conductive foam material that enhances heat transfer, for example graphite foam. These shell-and-tube heat exchangers are highly efficient, inexpensive to build, and corrosion resistant. The described heat exchangers can be used in a variety of applications, including but not limited to, low thermal driving force applications, power generation applications, and non-power generation applications such as refrigeration and cryogenics. The foam heat transfer units can be made from any thermally conductive foam material including, but not limited to, graphite foam or metal foam. In an embodiment, the heat exchanger utilizes tubes that are twisted around a central foam heat transfer unit.

10 Claims, 13 Drawing Sheets

(51) Int. Cl.
*F28F 9/22* (2006.01)
*F28F 13/00* (2006.01)
*F28F 21/02* (2006.01)

(52) U.S. Cl.
CPC ..... *F28F 13/003* (2013.01); *F28F 21/02* (2013.01); *F28F 2009/226* (2013.01); *F28F 2275/025* (2013.01); *F28F 2275/062* (2013.01)

(56) References Cited

U.S. PATENT DOCUMENTS 2,429,508 A 10/1947 Belaieff
2,693,942 A * 11/1954 Guala ..... F28F 9/22 165/159
2,792,200 A 5/1957 Huggins et al.
2,821,369 A * 1/1958 Hilliard ..... 165/159
2,834,714 A * 5/1958 Denison, Jr. ..... C07D 417/06 435/76
3,288,573 A 11/1966 Abos
3,289,757 A 12/1966 Rutledge
3,294,159 A 12/1966 Kovalik et al.
3,334,026 A 8/1967 Dobell
3,359,753 A 12/1967 Fiedler et al.
3,400,758 A * 9/1968 Lee ..... F28F 9/22 159/901
3,489,654 A 1/1970 Geiringer
3,595,310 A 7/1971 Burne et al.
3,630,276 A * 12/1971 Paine ..... F22B 1/023 122/32
3,818,984 A 6/1974 Nakamura et al.
4,136,428 A 1/1979 Godsey et al.
4,325,734 A 4/1982 Burrage et al.
4,347,083 A 8/1982 Sara
4,360,059 A * 11/1982 Funke ..... F28D 7/026 165/160
4,438,809 A 3/1984 Papis
4,475,988 A 10/1984 Tsumura et al.
4,493,368 A * 1/1985 Gronnerud et al. ..... 165/159
4,697,321 A * 10/1987 Shibuya ..... B21D 5/02 29/727
4,699,211 A * 10/1987 Geary ..... F28F 9/22 165/159
4,715,438 A 12/1987 Gabuzda et al.
4,724,754 A 2/1988 Crozat et al.
4,993,223 A 2/1991 Kretzinger
5,046,331 A 9/1991 O'Neal et al.
5,058,664 A 10/1991 Gentry
5,063,663 A 11/1991 Casterline
5,078,206 A 1/1992 Goetz, Jr.
5,095,708 A 3/1992 Kalina
5,100,049 A 3/1992 Divecha et al.
5,113,052 A 5/1992 Gabriel
5,132,780 A 7/1992 Higgins, III
5,172,752 A 12/1992 Goetz, Jr.
5,273,106 A 12/1993 Drake
5,480,676 A 1/1996 Sonuparlak et al.
5,513,494 A 5/1996 Flynn et al.
5,582,245 A 12/1996 Niimi
5,755,280 A 5/1998 da Costa et al.
5,797,449 A 8/1998 Oswald et al.
5,832,991 A * 11/1998 Cesaroni ..... F28F 9/22 165/160
5,878,590 A 3/1999 Kadle et al.
5,882,461 A 3/1999 Rogut
6,167,713 B1 1/2001 Hartfield et al.
6,259,165 B1 7/2001 Brewington
6,386,275 B1 5/2002 Kuo et al.
6,438,936 B1 8/2002 Ryan
6,516,627 B2 2/2003 Ring et al.
6,537,351 B2 3/2003 Margiott et al.
6,552,902 B2 4/2003 Cho et al.
6,673,328 B1 1/2004 Klett et al.
6,694,740 B2 2/2004 Nayar
6,763,671 B1 7/2004 Klett et al.
6,780,505 B1 8/2004 Klett et al.
6,827,138 B1 * 12/2004 Master et al. ..... 165/159
6,838,202 B2 1/2005 Brady et al.
7,013,963 B2 3/2006 Laine et al.
7,063,130 B2 6/2006 Huang
7,147,214 B2 12/2006 Klett et al.
7,306,654 B2 12/2007 King et al.
7,331,381 B2 * 2/2008 Wang et al. ..... 165/166
7,401,643 B2 7/2008 Queheillalt et al.
7,431,805 B2 10/2008 Beckman
7,472,549 B2 1/2009 Brewington
7,740,057 B2 * 6/2010 Wang ..... F28D 7/1607 165/159
7,762,101 B1 7/2010 Zuili et al.
7,766,076 B2 8/2010 Khalili et al.
7,857,039 B2 12/2010 Nakamura
8,020,610 B2 9/2011 Soldner et al.
8,272,431 B2 9/2012 Campagna et al.
8,567,195 B2 10/2013 Nash
8,800,849 B2 8/2014 Jansen et al.
9,080,818 B2 7/2015 Maurer et al.
2002/0017108 A1 2/2002 Schooley
2002/0121359 A1 9/2002 Heikkila et al.
2003/0000486 A1 1/2003 Ott et al.
2003/0154865 A1 8/2003 Zornes
2003/0173062 A1 9/2003 Leomax, Jr. et al.
2004/0194944 A1 10/2004 Hendricks et al.
2004/0244398 A1 12/2004 Radermacher et al.
2005/0008890 A1 1/2005 Raghunathan et al.
2005/0109493 A1 5/2005 Wu et al.
2005/0121304 A1 6/2005 Beckman
2005/0178534 A1 8/2005 Kienbock et al.
2006/0124284 A1 6/2006 Ushio et al.
2006/0162913 A1 7/2006 Wanni et al.
2006/0237172 A1 10/2006 Lo
2006/0254757 A1 11/2006 Kamsma
2007/0119907 A1 5/2007 Rodhammer
2007/0144500 A1 6/2007 Dupree et al.
2007/0175609 A1 8/2007 Christ et al.
2007/0199683 A1 8/2007 Emrich
2007/0228109 A1 10/2007 Smith et al.
2007/0228113 A1 10/2007 Dupree et al.
2007/0284095 A1 12/2007 Wang et al.
2008/0093059 A1 * 4/2008 Nishida ..... 165/133
2008/0149311 A1 6/2008 Liu et al.
2008/0166492 A1 7/2008 Lu et al.
2008/0196869 A1 * 8/2008 Behrens et al. ..... 165/104.33
2008/0251215 A1 10/2008 Chen
2008/0251238 A1 10/2008 Gudmundsson
2009/0126918 A1 5/2009 Campagna et al.
2009/0178790 A1 7/2009 Schreiber et al.
2009/0218070 A1 9/2009 Fries et al.
2009/0288814 A1 11/2009 Stoia et al.
2009/0308571 A1 12/2009 Thompson et al.
2009/0308582 A1 * 12/2009 Nagurny et al. ..... 165/167
2010/0006273 A1 1/2010 Du et al.
2010/0055478 A1 3/2010 Chaumat et al.
2010/0181054 A1 7/2010 Nagurny et al.
2010/0318437 A1 12/2010 Yee et al.
2011/0011570 A1 1/2011 Levings et al.
2011/0011572 A1 1/2011 Nagurny et al.
2011/0016906 A1 1/2011 Zuili et al.
2011/0079375 A1 4/2011 Nagurny et al.
2011/0127022 A1 6/2011 Eller et al.
2012/0091729 A1 4/2012 Nash
2012/0177488 A1 7/2012 Corman
2012/0199330 A1 8/2012 Maurer et al.
2012/0199334 A1 8/2012 Maurer et al.
2012/0199335 A1 8/2012 Maurer
2012/0282454 A1 11/2012 Jansen et al.
2013/0146250 A1 6/2013 Eller et al.
2013/0146437 A1 6/2013 Maurer et al.

FOREIGN PATENT DOCUMENTS

CN 1149707 A 5/1997
CN 1276515 A 12/2000
DE 854658 C 11/1952
DE 1117148 11/1961
DE 1161922 B 1/1964

(56) References Cited

FOREIGN PATENT DOCUMENTS

| | | | |
|---|---|---|---|
| DE | 3615300 | A1 | 11/1987 |
| DE | 19850557 | A1 | 5/2000 |
| DE | 10221138 | A1 | 2/2004 |
| EP | 1553379 | A1 | 7/2005 |
| EP | 2124009 | A2 | 11/2009 |
| GB | 2424265 | A | 9/2006 |
| JP | 03207993 | A | 9/1991 |
| JP | 2009005683 | A | 1/2009 |
| WO | 9966136 | A1 | 12/1999 |
| WO | 2004027336 | A1 | 4/2004 |
| WO | 2008042893 | A2 | 4/2008 |
| WO | 2009/137653 | | 11/2009 |
| WO | 2010116230 | A2 | 10/2010 |

OTHER PUBLICATIONS

U.S. Appl. No. 13/431,361, filed Mar. 17, 2012 (16 pages).
U.S. Appl. No. 13/365,461, filed Feb. 3, 2012 (32 pages).
U.S. Appl. No. 13/365,460, filed Feb. 3, 2012 (34 pages).
U.S. Appl. No. 13/365,456, filed Feb. 3, 2012 (35 pages).
International Search Report for international application No. PCT/US2012/023783, dated Sep. 20, 2012 (6 pages).
Written Opinion for international application No. PCT/US2012/023783, dated Sep. 20, 2012 (8 pages).
Author Unknown, "500F Thermally Conductive Epoxies," located online at www.cotronics.com/vo/cotr/ea_thermallyconductive.htm, 2008, Cotronics Corp., 2 pages.
Author Unknown, "Vahterus PSHE Series Plate and Shell Heat Exchangers," product description, TI-P228-01, CH Issue 1, located online at www.spiraxsarco.com/pdfs/TI/p228_01.pdf, Spirax Sarco, 2007, 2 pages.
Author Unknown, "S-Bond Technology: Foams," located online at www.s-bond.com/SolderJointStructures/Foams.htm, S-Bond Technologies, accessed May 16, 2016, 2 pages.
Author Unknown, "The Fiberglass Advantages," Fiberglass Fabrication, Jun. 23, 2003 (date obtained using wayback machine), Structural Fiberglass Inc., www.structuralfiberglass.com/advant, 1 page.
Author Unknown, "Graphite Foam," Oak Ridge National Laboratory, Issue 174, Section: Smart Technology, Apr. 2, 2002, http://www.autospeed.com/cms/title_Graphite-Foam/A_1339/printArticle.html, 4 pages.
Author Unknown, "Main Thermocline," Aerographer/Meteorology, Apr. 15, 2003 (date obtained using wayback machine), Integrated Publishing, Inc., www.tpub.com/weather3/1-21, 2 pages.
El-Dessouky, H. et al., "Plastic/compact heat exchangers for single-effect desalination systems," Desalination 122, 1999, pp. 271-289.
Harrison, Sara, "Ocean Thermal Energy Conversion," Submitted as coursework for Physics 240, Stanford University, Nov. 28, 2010, large.stanford.edu/courses/2010/ph240/harrison2/, pp. 1-6.
Jacobi, A.M. et al., "Novel Materials for Heat Exchangers," Air Conditioning and Refrigeration Center, Mechanical Science and Engineering, University of Illinois, ARTI Report No. 06030-01, Mar. 2008, 446 pages.
Klett, J., "High Thermal Conductivity Graphite Foams for Compact Lightweight Radiators," Oak Ridge National Laboratory, U.S. Department of Energy, www.ms.ornl.gov/sections/mpsl/Cimtech/default.htm, May 9, 2002, 17 slides.
Malloy, D., "Lockheed Martin's Approach to Alternative Energy," E2DI Journal, www,e2dinternational.co.uk and www.dynamixx.co.uk, Jun. 2009, pp. 14-15.
Narayan, G. Prakash et al., "Helium as a Carrier Gas in Humidification Dehumidification Desalination Systems," Proceedings of ASME 2011 International Mechanical Engineering Congress and Exposition (IMECE), IMECE2011-62875, Nov. 11-17, 2011, Denver, Colorado, ASME, 8 pages.
Shah, Ramesh K., "Extended Surface Heat Transfer," Thermopedia, Feb. 14, 2011, www.thermopedia.com/content/750, pp. 1-8.
International Search Report and Written Opinion for International Patent Application No. PCT/US2012/023781, mailed Aug. 1, 2012, 8 pages.
International Preliminary Report on Patentability for International Patent Application No. PCT/US2012/023781, mailed Aug. 15, 2013, 7 pages.
Invitation to Pay Additional Fees and Partial International Search for PCT/US2012/066294, mailed Aug. 1, 2013, 6 pages.
International Search Report and Written Opinion for PCT/US2012/066294, mailed Oct. 25, 2013, 16 pages.
International Preliminary Report on Patentability for PCT/US2012/066294, mailed May 27, 2014, 11 pages.
International Search Report and Written Opinion for PCT/US2012/068536, mailed Jun. 17, 2013, 11 pages.
International Preliminary Report on Patentability for PCT/US2012/068536, mailed Jun. 10, 2014, 9 pages.
International Preliminary Report on Patentability for International Patent Application No. PCT/US2012/023783, mailed Aug. 15, 2013, 9 pages.
International Search Report and Written Opinion for International Patent Application No. PCT/US2012/023786, mailed Jan. 21, 2013, 9 pages.
International Preliminary Report on Patentability for International Patent Application No. PCT/US2012/023786, mailed Aug. 15, 2013, 7 pages.
International Search Report and Written Opinion for International Patent Application No. PCT/US2012/023788, mailed Jul. 30, 2012, 9 pages.
International Preliminary Report on Patentability for International Patent Application No. PCT/US2012/023788, mailed Aug. 15, 2013, 7 pages.
International Search Report and Written Opinion for International Patent Application No. PCT/US2012/030853, mailed Jul. 3, 2012, 7 pages.
International Preliminary Report on Patentability for International Patent Application No. PCT/US2012/030853, mailed Nov. 14, 2013, 6 pages.
Non-final Office Action for U.S. Appl. No. 13/365,456, mailed May 22, 2014, 11 pages.
Final Office Action for U.S. Appl. No. 13/365,456, mailed Dec. 5, 2014, 12 pages.
Notice of Allowance for U.S. Appl. No. 13/365,456, mailed Mar. 23, 2015, 7 pages.
Non-Final Office Action for U.S. Appl. No. 13/708,457, mailed Oct. 24, 2014, 18 pages.
Final Office Action for U.S. Appl. No. 13/708,457, mailed Feb. 13, 2015, 18 pages.
Non-Final Office Action for U.S. Appl. No. 13/708,457, mailed Sep. 11, 2015, 16 pages.
Non-Final Office Action for U.S. Appl. No. 13/683,534, mailed Oct. 19, 2015, 25 pages.
Non-final Office Action for U.S. Appl. No. 13/365,460, mailed Mar. 25, 2015, 13 pages.
Non-final Office Action for U.S. Appl. No. 13/365,460, mailed Aug. 28, 2015, 16 pages.
Final Office Action for U.S. Appl. No. 13/365,460, mailed Apr. 21, 2016, 17 pages.
Non-final Office Action for U.S. Appl. No. 13/365,461, mailed May 5, 2014, 9 pages.
Final Office Action for U.S. Appl. No. 13/365,461, mailed Nov. 3, 2014, 13 pages.
Non-final Office Action for U.S. Appl. No. 13/365,461, mailed May 22, 2015, 12 pages.
Final Office Action for U.S. Appl. No. 13/365,461, mailed Sep. 25, 2015, 13 pages.
Notice of Allowance for U.S. Appl. No. 13/365,461, mailed Mar. 25, 2016, 7 pages.
Notice of Allowance and Examiner-Initiated Interview Summary for U.S. Appl. No. 13/431,361, mailed Apr. 14, 2014, 9 pages.
Author Unknown, "Closed Cycle Ocean Thermal Energy Conversion (OTEC)," Renewable Energy Sources, newenergyportal.wordpress.com/2009/12/15/closed-cycle-ocean-thermal-energy-conversion-otec/, Dec. 15, 2009, 4 pages.
Final Office Action for U.S. Appl. No. 13/708,457, mailed Apr. 7, 2016, 16 pages.
Final Office Action for U.S. Appl. No. 13/683,534, mailed May 19, 2016, 20 pages.

* cited by examiner

SHELL-AND-TUBE HEAT EXCHANGERS WITH FOAM HEAT TRANSFER UNITS

This application claims the benefit of U.S. Provisional Applicant Ser. No. 61/439,564, filed on Feb. 4, 2011, the entire contents of which are incorporated herein by reference.

FIELD

This disclosure relates to heat exchangers in general, and, more particularly, to heat exchangers, including but not limited to shell-and-tube heat exchangers, employing heat conducting foam material.

BACKGROUND

Heat exchangers are used in many different types of systems for transferring heat between fluids in single phase, binary or two-phase applications. An example of a commonly used heat exchanger is a shell-and-tube heat exchanger. Generally, a shell-and-tube heat exchanger includes multiple tubes placed between two tube sheets and encapsulated in a shell. A first fluid is passed through the tubes and a second fluid is passed through the shell such that it flows past the tubes separated from the first fluid. Heat energy is transferred between the first fluid and second fluid through the walls of the tubes.

A shell-and-tube heat exchanger is considered the primary heat exchanger in industrial heat transfer applications since they are economical to build and operate. However, shell-and-tube heat exchangers are not generally known for having high heat transfer efficiency.

SUMMARY

Shell-and-tube heat exchangers are described that utilize one or more foam heat transfer units engaged with the tubes to enhance the heat transfer between first and second fluids. The foam of the heat transfer units can be any thermally conductive foam material that enhances heat transfer, for example graphite foam. The shell-and-tube heat exchangers described herein are highly efficient, inexpensive to build, and corrosion resistant. The described heat exchangers can be used in a variety of applications, including but not limited to, low thermal driving force applications, power generation applications, and non-power generation applications such as refrigeration and cryogenics. The foam heat transfer units can be made from any thermally conductive foam material including, but not limited to, graphite foam or metal foam.

In one embodiment, a heat exchanger includes a tube having a central axis and an outer surface. A heat transfer unit is connected to and in thermal contact with the outer surface of the tube, with the heat transfer unit having a heat transfer surface extending substantially radially from the outer surface of the tube. The heat transfer unit includes graphite foam. For example, the heat transfer can consist essentially of, or consist of, graphite foam.

In another embodiment, a heat exchanger includes a tube bundle having a central axis and a plurality of tubes for conveying a first fluid. A first tube sheet and a second tube sheet are provided, and each of the tubes includes a first end joined to the first tube sheet in a manner to prevent fluid leakage between the first end and the first tube sheet and a second end joined to the second tube sheet in a manner to prevent fluid leakage between the second end and the second tube sheet. A heat transfer unit is connected to and in thermal contact with the tubes, with the heat transfer unit consisting essentially of graphite foam.

One suitable method for connecting the tubes and the tube sheets is friction-stir-welding (FSW). The use of FSW is particularly beneficial in heat exchanger applications subject to corrosive service, since the FSW process eliminates seams, no dissimilar metals are used and, in the case of saltwater environments, no galvanic cell is created.

In another embodiment, the heat transfer unit is in the form of a generally radiused and wedge-shaped, planar body that consists essentially of foam material, for example graphite foam. The body includes first and second opposite major surfaces, a support rod hole or cut-out extending through the body from the first major surface to the second major surface, an arcuate radially outer edge connected to linear side edges at opposite ends of the outer edge, and at least two tube contact surfaces opposite the radially outer edge. In other embodiments, the heat transfer units can be a combination of radiused and triangular or square shaped to fit in the pitch space between tubes. All of the heat transfer units described herein can be used by themselves or together in various combinations that one finds suitable to increase the heat transfer efficiency of the heat exchanger.

In an embodiment, the tubes can be twisted around a foam heat transfer unit. In addition, each tube can be twisted around its own axis to further increase heat transfer efficiency.

The tubes of the shell-and-tube heat exchangers described herein can be arranged in numerous patterns and pitches, including but not limited to, an equilateral triangular pattern defining a triangular pitch between tubes, a square pattern defining a square pitch between tubes, and a staggered square pattern defining a square or diamond pitch between tubes.

The shell-and-tube heat exchangers described herein can also be configured to have any desired flow configuration, including but not limited to, cross-flow, counter-current flow, and co-current flow. In addition, the tubes can have any desired tube layout/configuration including, but not limited to, single pass and multi-pass. Further, the shell, tubes, tube sheets, and other components of the described heat exchangers can be made of any materials suitable for the desired application of the heat exchanger including, but not limited to, metals such as aluminum, titanium, copper and bronze, steels such as carbon steel and high alloy stainless steels, and non-metals such as plastics, fiber-reinforced plastics, thermally enhanced polymers, and thermoplastics.

DRAWINGS

Figure 5:
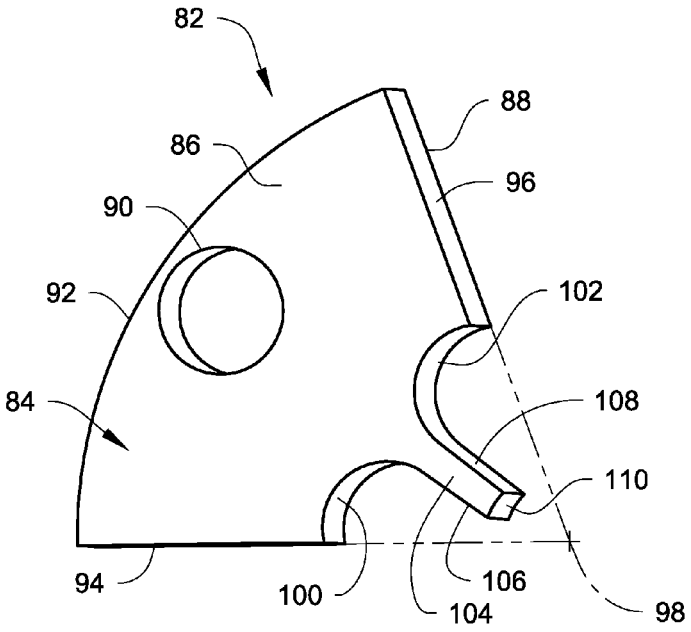
FIG. 5 illustrates a foam heat transfer unit used with the tube bundle of FIGS. 2-4.

FIGS. 6A-E illustrate an exemplary process of forming the heat transfer unit of FIG. 5.

Figure 7:
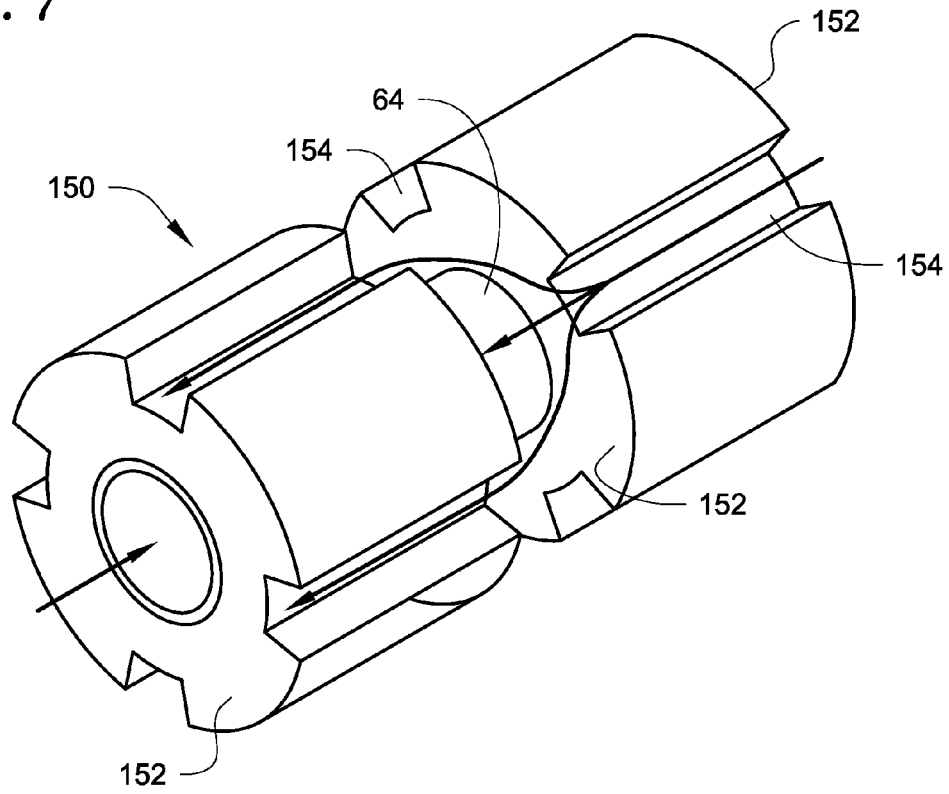

FIG. 7 illustrates another example of a foam heat transfer unit useable with the tube bundle.

Figure 8:
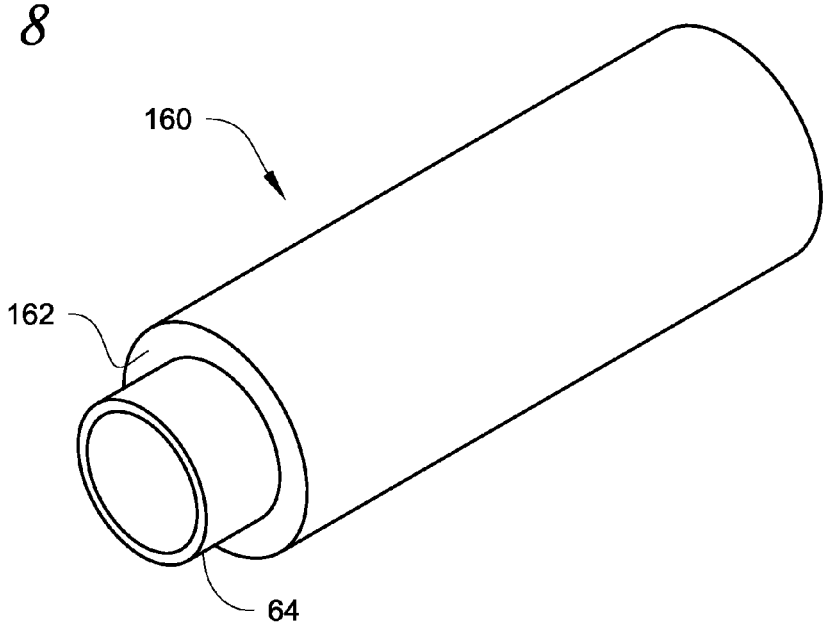

FIG. 8 illustrates still another example of a foam heat transfer unit.

Figure 9:
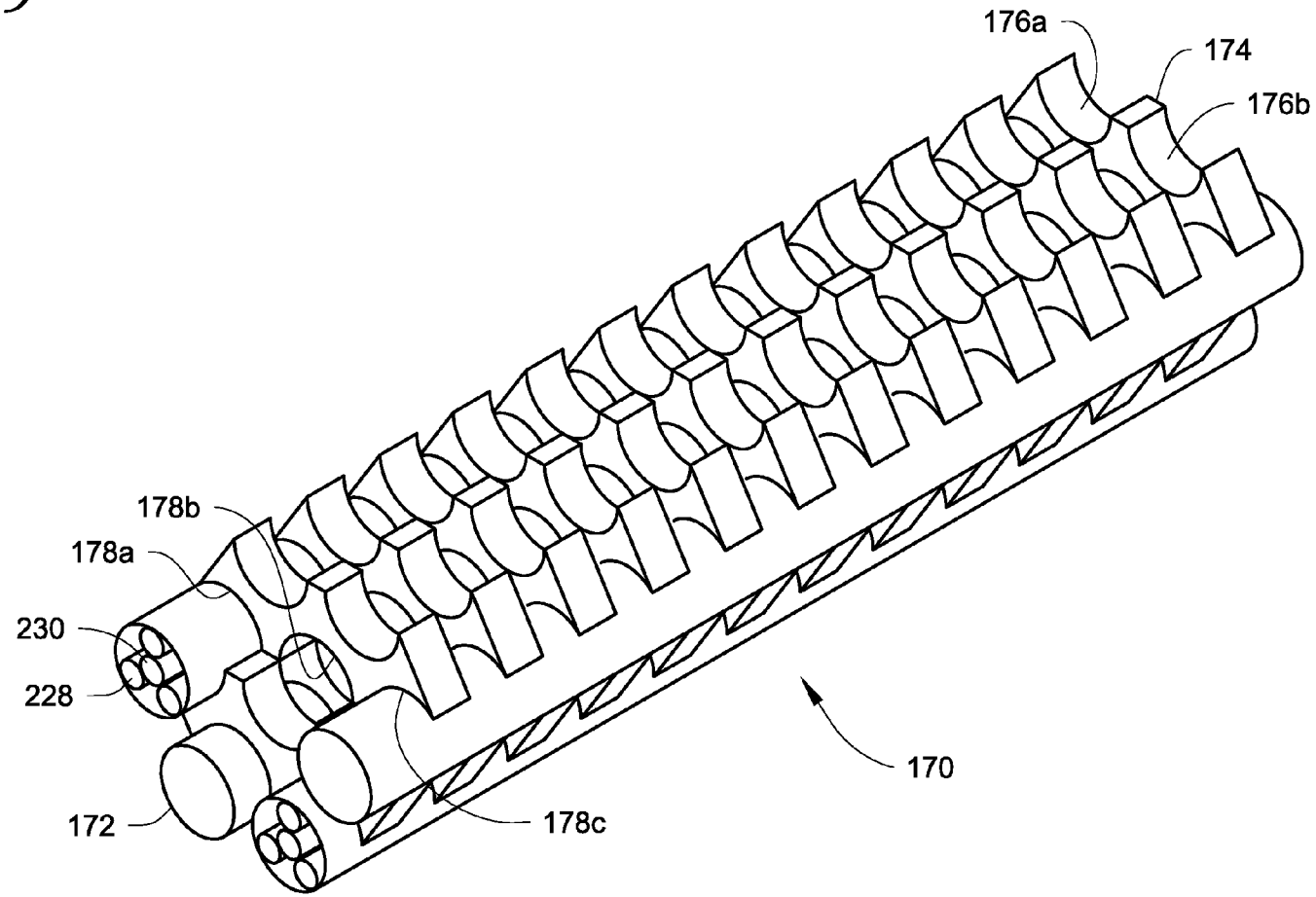

FIG. 9 illustrates still another example of a foam heat transfer unit.

Figure 10A:
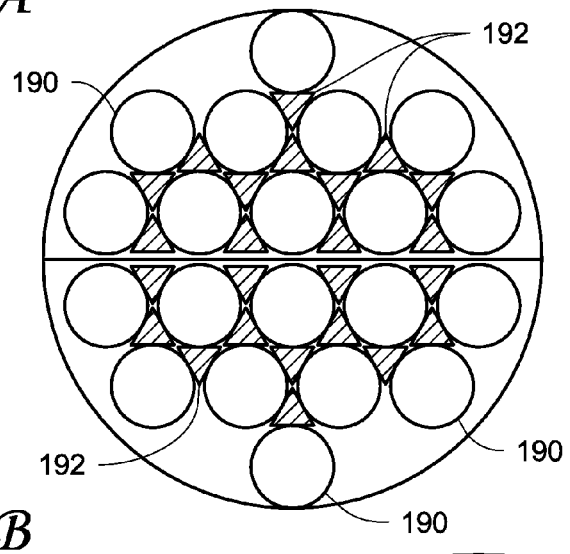

FIG. 10A is a cross-sectional view of a tube bundle with another example of a foam heat transfer unit.

Figure 10B:
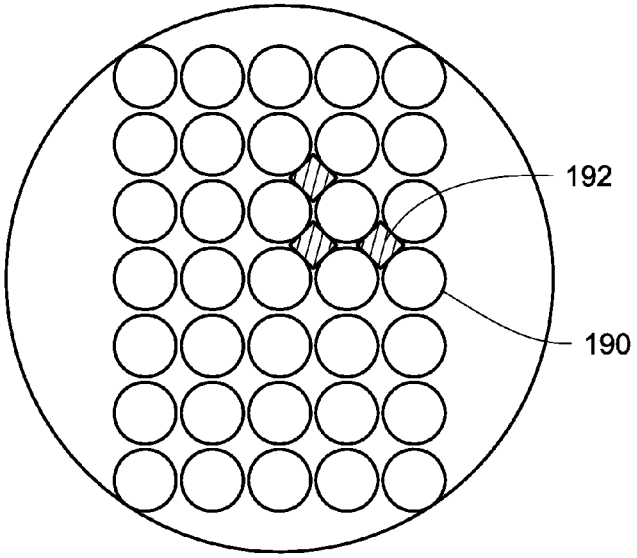
Figure 10C:
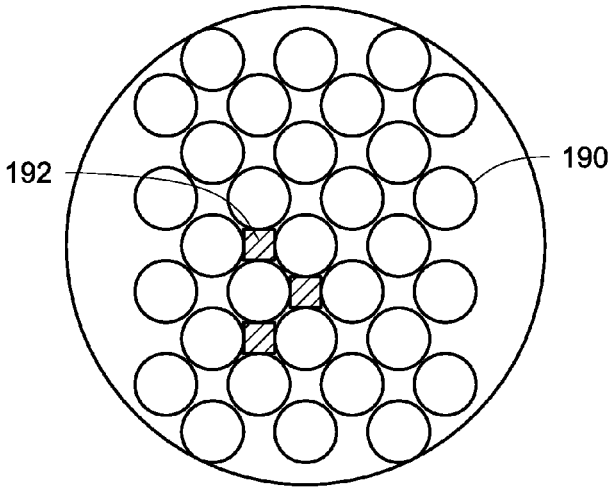

FIGS. 10B and 10C illustrate additional examples of tube patterns for tube bundles.

Figure 11:
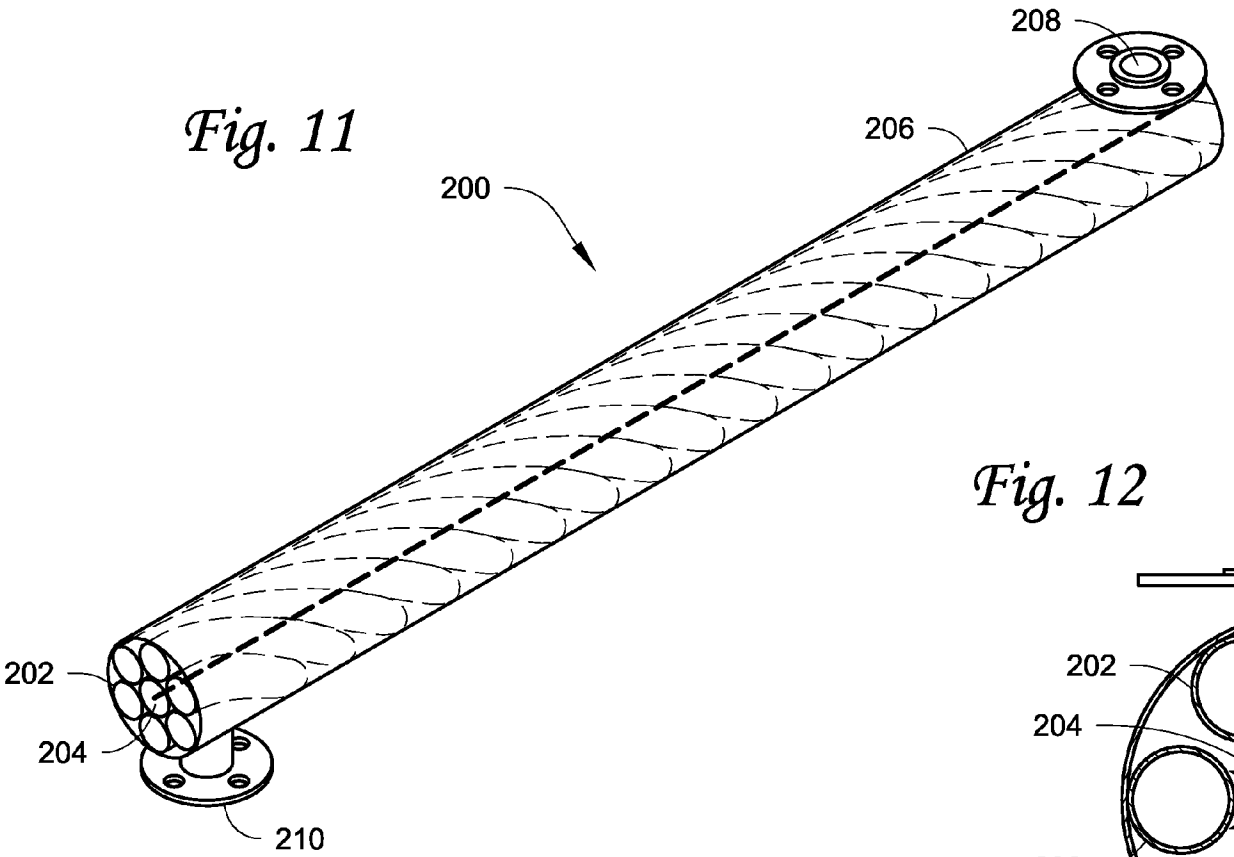

FIG. 11 illustrates an example of an improved shell-and-tube heat exchanger that employs twisted tubes together with a foam heat transfer unit.

Figure 12:
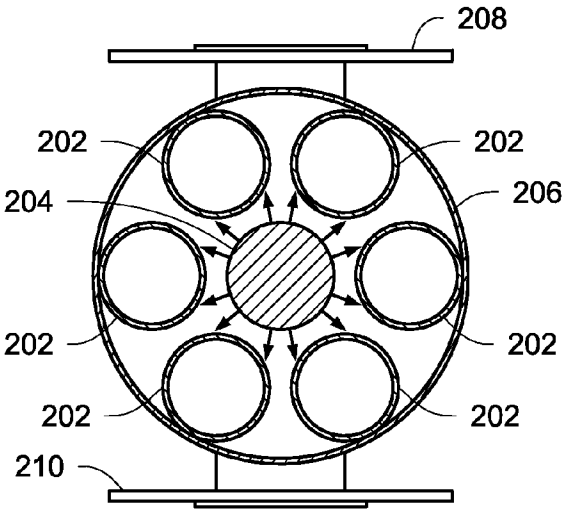

FIG. 12 is a cross-sectional view of the shell-and-tube heat exchanger of FIG. 11.

Figure 13:
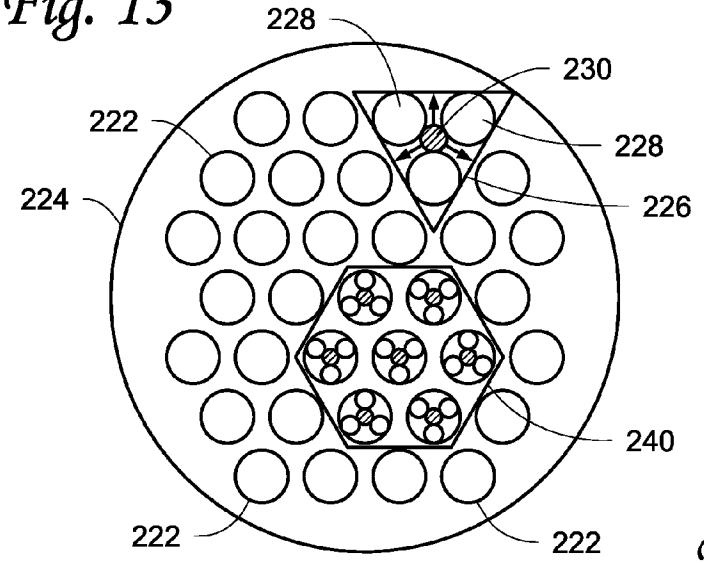

FIG. 13 is a cross-sectional view of another implementation of twisted tubes and foam heat transfer units.

Figure 14:
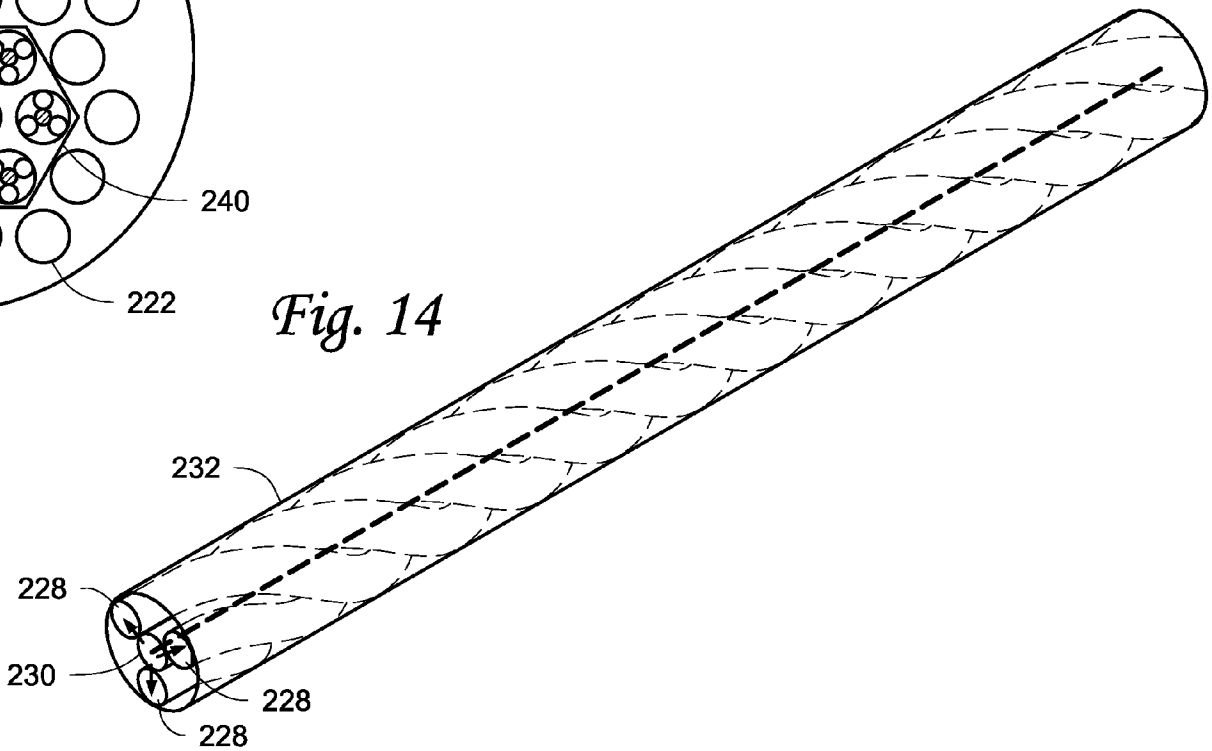

FIG. 14 illustrates details of the portion within the triangle in FIG. 13.

Figure 15:
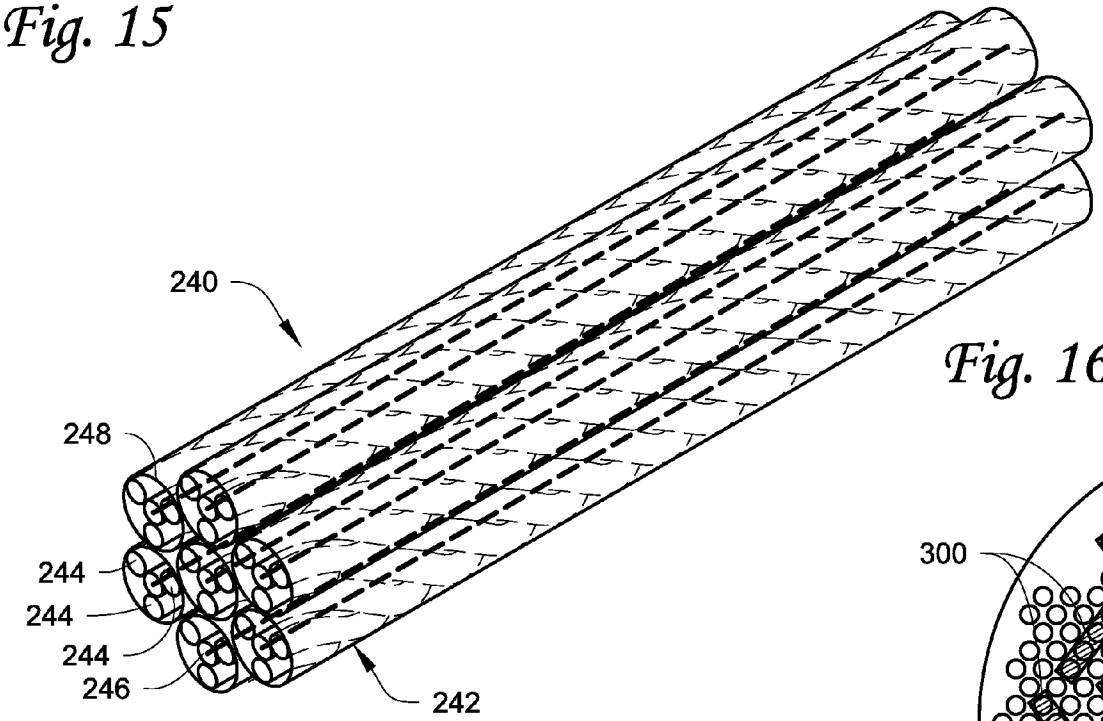

FIG. 15 illustrates details of the portion within the hexagon in FIG. 13.

Figure 16:
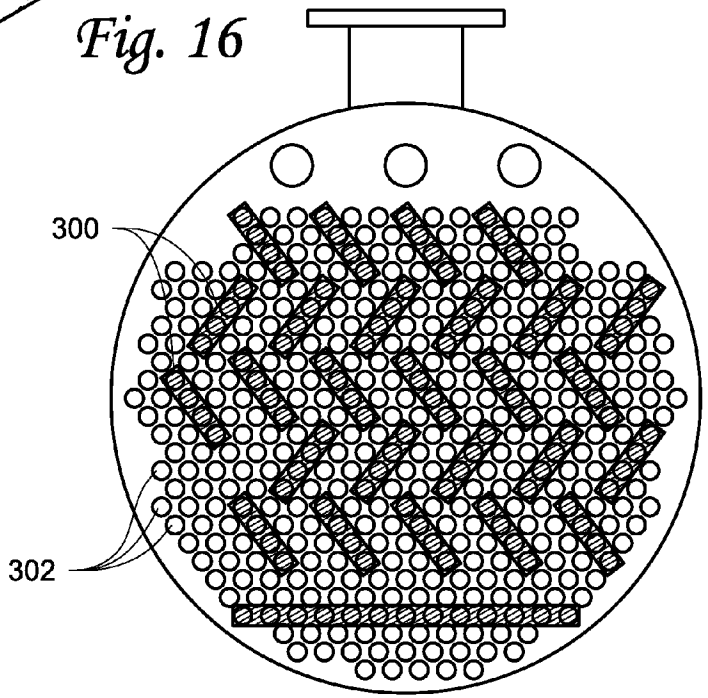

FIG. 16 is a cross-sectional view of an improved shell-and-tube heat exchanger that employs an additional example of foam heat transfer units.

FIGS. 17A-F illustrate examples of patterns formed by different configurations of foam heat transfer units.

Figure 18:
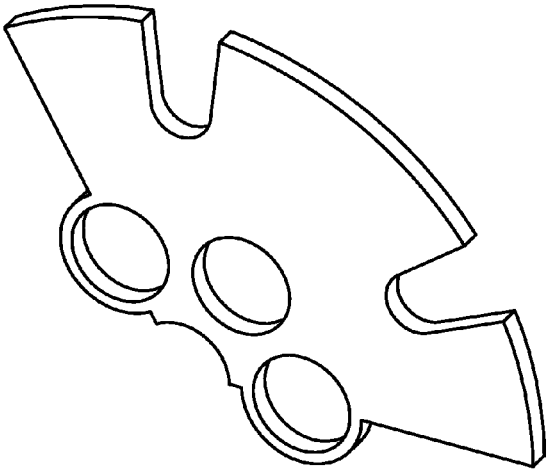

FIG. 18 shows an example of a plate that can be used to strengthen a heat transfer unit.

DETAILED DESCRIPTION

Figure 1:
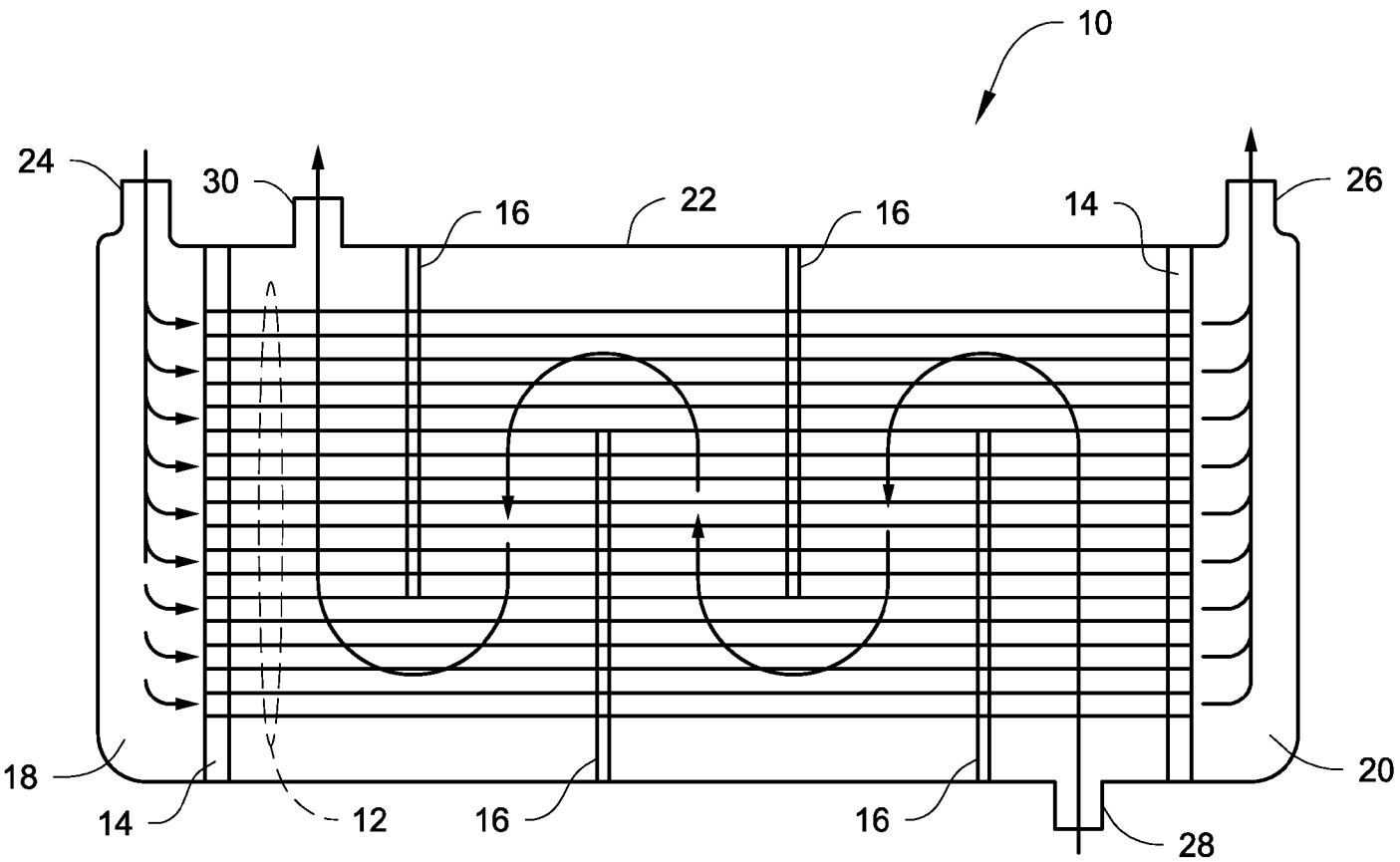
Fig. 1 (Prior Art)
FIG. 1 shows a conventional shell-and-tube heat exchanger.

FIG. 1 shows a conventional shell-and-tube heat exchanger 10 that is configured to exchange heat between a first fluid and a second fluid in a single-pass, primarily counter-flow (the two fluids flow primarily in opposite directions) arrangement. The heat exchanger 10 has tubes 12, a tube sheet 14 at each end of the tubes, baffles 16, an input plenum 18 for a first fluid, an output plenum 20 for the first fluid, a shell 22, an inlet 24 to the input plenum for the first fluid, and an outlet 26 from the output plenum for the first fluid. In addition, the shell 22 includes an inlet 28 for a second fluid and an outlet 30 for the second fluid.

The first fluid and the second fluid are at different temperatures. For example, the first fluid can be at a lower temperature than the second fluid so that the second fluid is cooled by the first fluid.

During operation, the first fluid enters through the inlet 24 and is distributed by the manifold or plenum 18 to the tubes 12 whose ends are in communication with the plenum 18. The first fluid flows through the tubes 12 to the second end of the tubes and into the output plenum 20 and then through the outlet 26. At the same time, the second fluid is introduced into the shell 22 through the inlet 28. The second fluid flows around and past the tubes 12 in contact with the outer surfaces thereof, exchanging heat with the first fluid flowing through the tubes 12. The baffles 16 help increase the flow path length of the second fluid, thereby increasing the interaction and residence time between the second fluid in the shell-side and the walls of tubes. The second fluid ultimately exits through the outlet 30.

Figure 2:
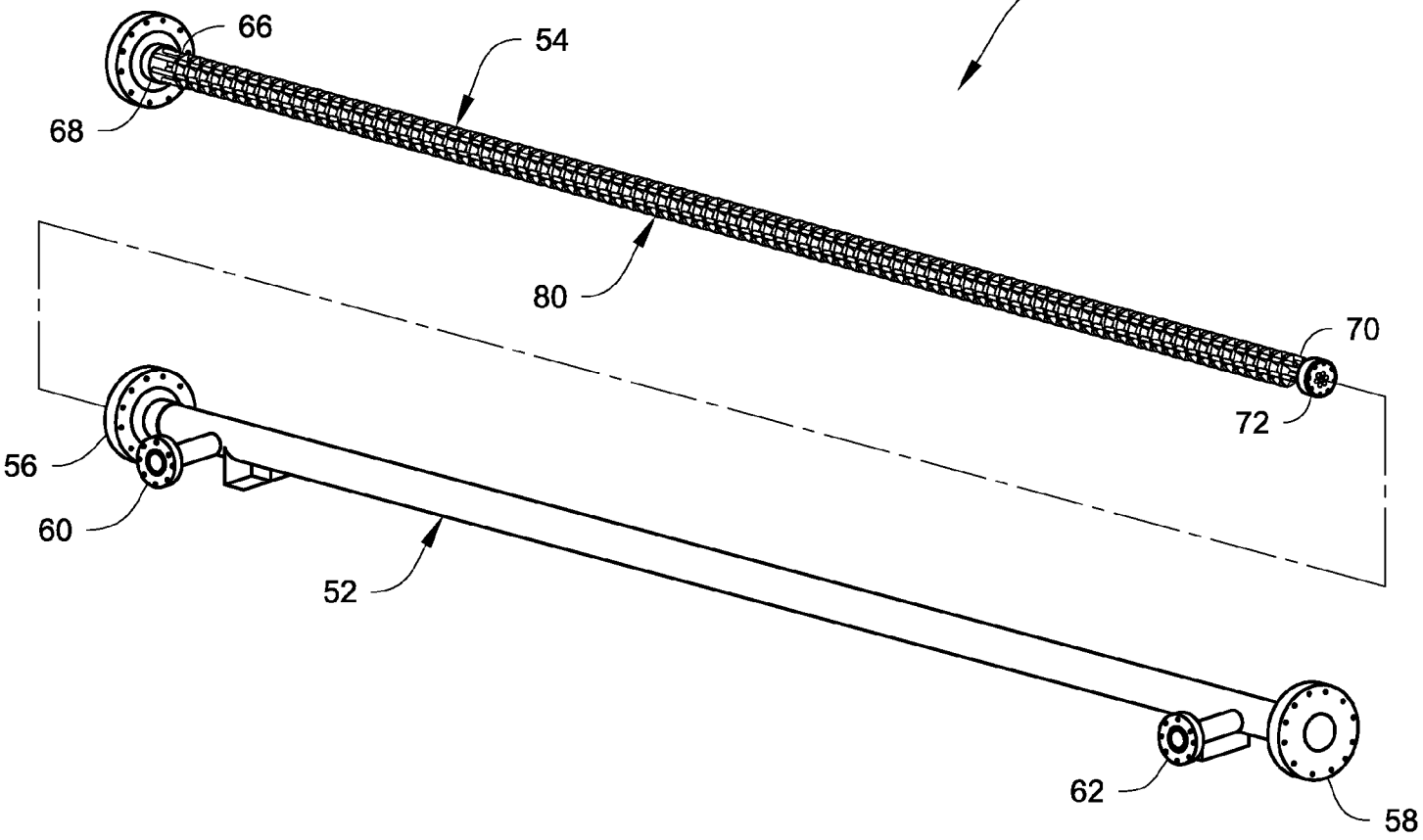
FIG. 2 is an exploded view of an improved shell-and-tube heat exchanger described herein.
Figure 3:
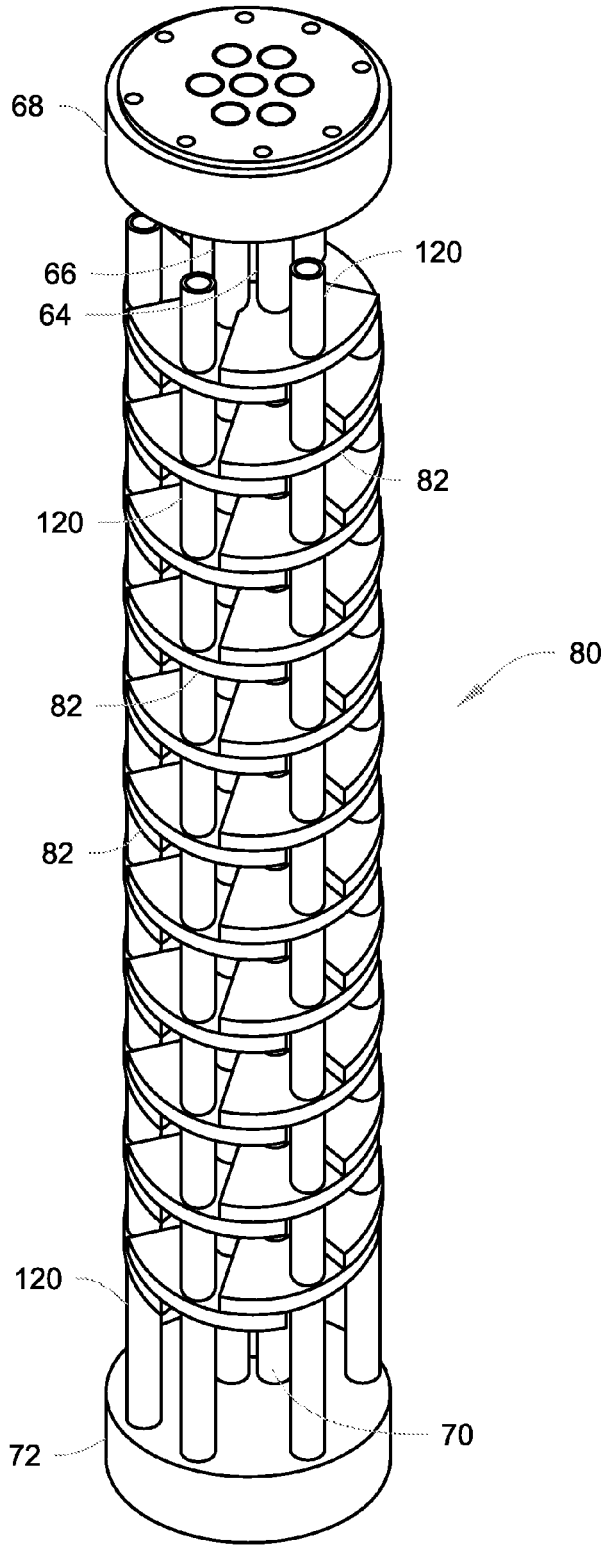
FIG. 3 illustrates a tube bundle for the shell-and-tube heat exchanger of FIG. 2.
Figure 4:
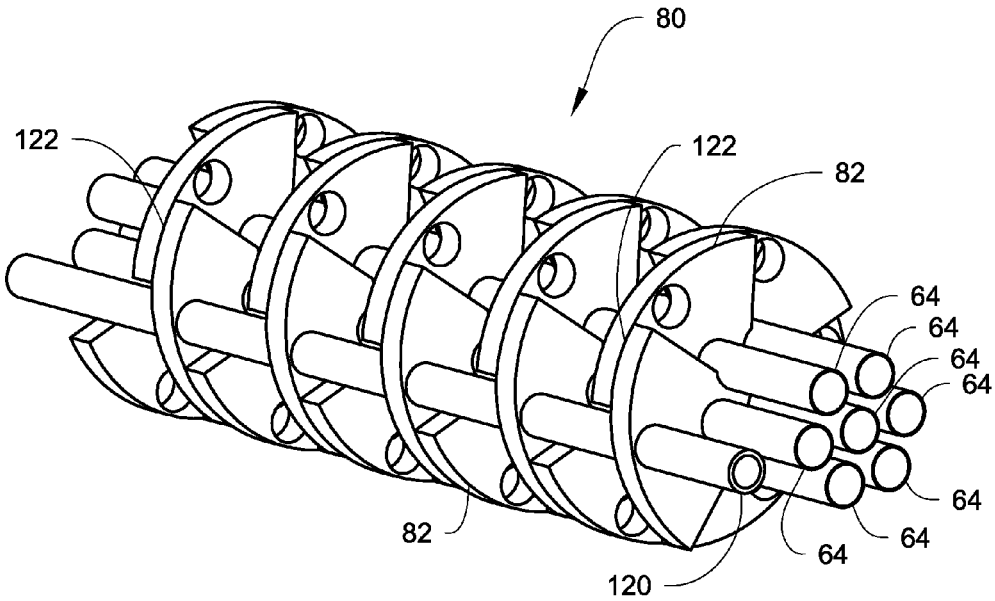
FIG. 4 is a partial view of the tube bundle of FIG. 3.

Turning to FIGS. 2-4, an improved shell-and-tube heat exchanger 50 is illustrated. The heat exchanger is illustrated as a single-pass, primarily counter-flow (the two fluids flow primarily in opposite directions) arrangement. However, it is to be realized that the heat exchanger 50 could also be configured as a multi-pass system, as well as for cross-flow (the two fluids flow primarily generally perpendicular to one another), co-current flow (the fluids primarily flow in the same directions), or the two fluids flow can flow at any angle therebetween.

The heat exchanger 50 includes a shell 52 and a tube bundle 54 that is configured to be disposable in the shell 52. In the illustrated embodiment, the shell 52 includes an axial inlet 56 at a first end for introducing a first fluid and an axial outlet 58 at the opposite second end for the first fluid. In addition, the shell includes a radial inlet 60 near the first end for introducing a second fluid and a radial outlet 62 near the second end for the second fluid.

The shell 52 is configured to enclose the tube bundle 54 and constrain the second fluid to flow along the surfaces of tubes in the tube bundle. The shell 52 can be made of any material that is suitably resistant to corrosion or other effects from contact with the type of second fluid being used, as well as be suitable for the environment in which the heat exchanger 50 is used. For example, the shell can be made of a metal including, but not limited to, steel or aluminum, or from a non-metal material including, but not limited to, a plastic or fiber-reinforced plastic.

The tube bundle 54 extends substantially the length of the shell and includes a plurality of hollow tubes 64 for conveying the first fluid through the heat exchanger 50. The tubes 64 are fixed at a first end 66 to a first tube sheet 68 and fixed at a second end 70 to a second tube sheet 72. As would be understood by a person of ordinary skill in the art, the tube sheets 68, 72 are sized to fit within the ends of the shell 52 with a relatively close fit between the outer surfaces of the tube sheets and the inner surface of the shell. When the tube bundle 54 is installed inside the shell 52, the tube sheets of the tube bundle and the shell collectively define an interior chamber that contains the tubes 64 of the tube bundle. The radial inlet 60 and radial outlet 62 for the second fluid are in fluid communication with the interior chamber. Due to the closeness of the fit and/or through additional sealing, leakage of the second fluid from the interior chamber of the shell past the interface between the outer surfaces of the tube sheets 68, 72 and the inner surface of the shell is prevented.

As shown in FIG. 3, the ends of the tubes 64 penetrate through the tube sheets 68, 72 via holes in the tube sheets so that inlets/outlets of the tubes are provided on the sides of the tube sheets facing away from the interior chamber of the shell. The ends of the tubes 64 may be attached to the tube sheets in any manner to prevent fluid leakage between the tubes 64 and the holes through the tube sheets. In one example, the ends of the tubes are attached to the tube sheets by FSW. The use of FSW is particularly beneficial where the heat exchanger is used in an environment where it is subject to corrosion, since the FSW process eliminates seams, no dissimilar metals are used and, in the case of saltwater environments, no galvanic cell is created.

FSW is a known method for joining elements of the same material. Immense friction is provided to the elements such that the immediate vicinity of the joining area is heated to temperatures below the melting point. This softens the adjoining sections, but because the material remains in a solid state, the original material properties are retained. Movement or stirring along the weld line forces the softened material from the elements towards the trailing edge, causing the adjacent regions to fuse, thereby forming a weld. FSW reduces or eliminates galvanic corrosion due to contact between dissimilar metals at end joints. Furthermore, the resultant weld retains the material properties of the material of the joined sections. Further information on FSW is disclosed in U.S. Patent Application Publication Number 2009/0308582, titled Heat Exchanger, filed on Jun. 15, 2009, which is incorporated herein by reference.

The tubes 64 and the tube sheets 68, 72 are preferably made of the same material, such as, for example, aluminum, aluminum alloy, or marine-grade aluminum alloy. Aluminum and most of its alloys, as well as high alloy stainless steels and titanium, are amenable to the use of the FSW joining technique. The tubes and tube sheets can also be made from other materials such as metals including, but not limited to, high alloy stainless steels, carbon steels, titanium, copper, and bronze, and non-metal materials including, but not limited to, thermally enhanced polymers or thermoset plastics.

Other joining techniques can be used to secure the tubes and the tube sheets, such as expansion, press-fit, brazing, bonding, and welding (such as fusion welding and lap welding), depending upon the application and needs of the heat exchanger and the user.

In the example illustrated in FIGS. 2-4, the tubes 64 are substantially round when viewed in cross-section and substantially linear from the end 66 to the end 70. However, the shape of the tubes, when viewed in cross-section, can be square or rectangular, triangular, oval shaped, or any other shape, and combinations thereof. In addition, the tubes need not be linear from end to end, but can instead be curved, helical, and other shape deviating from linear. A total of seven tubes 64 are illustrated in this example. However, it is to be realized that a smaller or larger number of tubes can be provided.

It is preferred that the tubes be made of a material, such as a metal like aluminum, that permits extrusion or other seamless formation of the tubes. By eliminating seams from the tubes, corrosion is minimized.

The tube bundle 54 also includes a baffle assembly 80 integrated therewith. In the illustrated embodiment, the baffle assembly 80 is formed by a plurality of discrete (i.e. separate) heat transfer units 82 that are connected to each other so that the baffle assembly 80 has a substantially helix-shape that extends along the majority of the length of the tube bundle 54 around the longitudinal axis of the tube bundle. More preferably the helix-shaped baffle assembly 80 formed by the heat transfer units 82 extends substantially the entire axial length of the tube bundle.

The baffle assembly 80 increases the interaction time between the second fluid in the interior chamber of the shell and the walls of the tubes 64. Further, as described further below, the heat transfer units 82 forming the baffle assembly are made of material that is thermally conductive, so that the baffle assembly 80 effectively increases the amount of surface area for thermal contact between the tubes and the second fluid. In addition, the substantially helix-shaped baffle assembly 80 substantially reduces or even eliminates dead spots in the interior chamber of the shell. The helix-shaped baffle assembly 80 can reduce pressure drop, reduce flow restriction of the fluid, and reduce the required force of pumping, yet at the same time provide directional changes of the second fluid to increase interaction between the second fluid and the tubes. Thus, the baffle assembly 80 provides the heat exchanger 50 with greater overall heat transfer efficiency between the second fluid and the tubes.

In an embodiment, the heat transfer units 82 can be strengthened by the use of solid or perforated plates, made from a thermally conductive material such as aluminum, affixed to the heat transfer units 82. The plates can be affixed to the units 82 in a periodic pattern along the helix, or they can be affixed to the units in any arrangement one finds provides a suitable strengthening function. The plates can be used to assist in the assembly of the tube bundle and the heat exchanger, and can assist with minimizing the pressure drop on the shell-side flow. FIG. 18 shows an example of such a plate.

Referring to FIG. 5 together with FIGS. 2-4, each heat transfer unit 82 comprises a generally wedge-shaped, planar body 84 having a generally triangular or pie-shape that has radiused inner surfaces to fit the curvature of the outer surfaces of the tubes. As described further below, the unit 82 includes a foam material such as graphite foam or metal foam. Preferably, the unit 82 consists essentially of the foam material, and more preferably consists of the foam material.

The body 84 includes a first major surface 86 and a second major surface 88 opposite the first major surface. In the illustrated embodiment, the major surfaces 86, 88 are substantially planar. However, one or more of the major surfaces 86, 88 need not be planar and could have contours or be shaped in a manner to facilitate fluid flow across or past the unit 82. Fin patterns shown in FIGS. 17A-17F could be used to enhance flow and heat transfer over the major surfaces 86, 88. The fins could extend substantially perpendicular to the surfaces 86, 88. Alternatively, certain edges of the body 84 could have fin patterns shown in FIG. 17A thru 17F to enhance flow and heat transfer from the edges of the heat transfer unit. A support rod hole 90 extends through the body 84 from the first major surface 86 to the second major surface 88 for receipt of a support rod described below. In another embodiment, an open-ended slot is used instead of the hole 90 to receive the support rod. Therefore, any opening, such as a hole or slot, could be used to receive the support rod.

The perimeter of the body 84 is defined by an arcuate radially outer edge 92 connected to linear side edges 94, 96 at opposite ends of the outer edge. The side edges 94, 96 converge toward a common center 98 which is removed during formation of the unit 82. The side edges 94, 96 terminate at radiused tube contact surfaces 100, 102, respectively, that are positioned on the body 84 opposite the radially outer edge 92.

Each of the contact surfaces 100, 102 is configured to connect to an outer surface of one of the tubes 64 for establishing thermal contact between the heat transfer unit 82 and the tubes. To maximize thermal contact, the contact surfaces 100, 102 are configured to match the outer surface of the tubes 64. In the illustrated embodiment, the contact surfaces 100, 102 are curved, arcuate, or radiused to generally match a portion of the outer surface of the tubes 64. However, the contact surfaces 100, 102 can have any shape that corresponds to the shape of the tubes, for example square or rectangular, triangular, oval, or any other shape, and combinations thereof.

The body 84 also includes a finger section 104 that in use extends between the two tubes 64 engaged with the contact surfaces 100, 102. The finger section 104 includes linear edges 106, 108 that extend from the contact surfaces 100, 102 and that terminate at a third tube contact surface 110 that is configured to contact an outer surface of a third tube 64 for establishing thermal contact with the third tube. The contact surface 110 is configured to match the outer surface of the third tube. In the illustrated embodiment, the contact surface is slightly curved or arcuate to generally match a portion of the outer surface of the third tube. However, the contact surface 110 can have any shape that corresponds to the shape of the third tube, for example square or rectangular, triangular, oval, or any other shape, and combinations thereof. In certain embodiments, for example where contact between the body 84 and a third tube is not desired or where there is insufficient space between the tubes for the finger section to extend through, the finger section 104 can be eliminated.

FIGS. 3 and 4 show the heat transfer units 82 mounted in position on the tube bundle 54. As shown in FIG. 3, a plurality of support rods 120 are mounted at one end thereof to the tube sheet 72 and extend substantially parallel to the tubes 64. The opposite ends of the support rods 120 are unsupported and not fixed to the tube sheet 68. In another embodiment, the opposite ends of the support rods are also fixed to the tube sheet 68. In the illustrated embodiment, four support rods 120 are provided and are evenly spaced around the tube bundle 54. However, a larger or smaller number of support rods 10 can be used based in part on the size of the heat transfer units 82 that are used.

The heat transfer units 82 are mounted on the tube bundle 54 with the outer edges 92 thereof facing radially outward. A support rod 120 extends through the hole 90 or other opening and the tube contact surfaces 100, 102, 110 are in thermal contact with outer surfaces of three separate tubes 64. When in thermal contact with the tubes, the major surfaces 86, 88 form heat transfer surfaces that extend substantially radially from the outer surfaces of the tubes. As used herein, "in thermal contact" includes direct or indirect contact between the tube contact surfaces and the tubes to permit transfer of thermal energy between the tube contact surfaces and the tubes. Indirect contact between the tube contact surfaces and the tubes could result from the presence of, for example, an adhesive or other material between the tube contact surfaces and the surfaces of the tubes. When a hole is used, the hole 90 is preferably sized such that a relatively tight friction fit is provided with the support rod 120 to prevent axial movement of the heat transfer unit on the rod. If desired, fixation of the heat transfer unit 82 on the rod 120 can be supplemented by fixation means, for example an adhesive between the hole 90 and the rod. Instead of the hole, a slot can be formed that receives the support rod which can be secured via a friction fit or bonded using an adhesive.

If adhesive bonding is used, the adhesive can be thermally conductive. The thermal conductivity of the adhesive can be increased by incorporating ligaments of highly conductive graphite foam, with the ligaments in contact with the surfaces heat transfer unit(s) and the tubes, and the adhesive forming a matrix around the ligaments to keep the ligaments in intimate contact with the tubes and heat transfer units. The ligaments will also enhance bonding strength by increasing resistance to shear, peel and tensile loads.

As best seen in FIG. 4, the heat transfer units 82 are arranged in a helical manner to form the baffle assembly 80. Each heat transfer unit is axially and rotationally offset from an adjacent heat transfer unit with a small overlap region 122 between each pair of adjacent heat transfer units. Because of the overlap regions 122, the baffle assembly formed by the heat transfer units is substantially continuous along the length of the tube bundle 54. The amount of overlap provided in the region 122 can vary based on the size and depth or thickness of the heat transfer units. In the overlap regions 122 the adjacent heat transfer units can be secured together. For example, the heat transfer units 82 can be frictionally engaged in the overlap regions so that friction maintains the relative rotational positions of the heat transfer units. Alternatively, an adhesive or other fixation technique can be provided at the overlap regions to fix the relative rotational positions of the heat transfer units.

The periodicity of the helix can be changed by altering the angle of rotation of the heat transfer units. For example, the helix can have an angle of 30 degrees, 60 degrees, 90 degrees, 120 degrees, 150 degrees, 180 degrees and other angles. A person having ordinary skill in the art can determine the desired angles of rotation depending upon, for example, the desired performance of the heat exchanger.

In addition, as discussed above, a metal plate (FIG. 18) can be used to strengthen the foam heat transfer units 82 and assist in fabrication of the tube bundle. The support plate can also be embedded within the foam heat transfer unit 82 during formation of the heat transfer units 82. The metal plate secures the positioning of the tubes in a fixed pattern as an alternating baffle that travels in a helical pattern down the tube axes. The metal plate can be used to overlap two or more foam pieces to provide strength of the graphite core assembly.

When the tube bundle is installed in the shell 52, the heat transfer units 82 are also sized such that the radially outer edges 92 thereof are positioned closely adjacent to, or in contact with, the interior surface of the shell to minimize or prevent the second fluid flowing in the shell from flowing between the radially outer edges 92 and the interior surface. This forces the majority of the fluid to flow past the tubes 64 in a generally spiral flow path defined by the heat transfer units 82. In some embodiments, the heat transfer units 82 need not overlap, but can instead be sized and mounted so as to have gaps between adjacent heat transfer units to permit some of the fluid to flow axially between the adjacent heat transfer units.

The unit 82 (as well as the heat transfer units described below) includes, consists essentially of, or consists entirely of, a foam material such as graphite foam or metal foam. The term foam material is used herein to describe a material having closed cells, open cells, coarse porous reticulated structure, and/or combinations thereof. Examples of metal foam include, but are not limited to, aluminum foam, titanium foam, bronze foam or copper foam. In an embodiment, the foam material does not include metal such as aluminum, titanium, bronze or copper.

In one embodiment, the foam material is preferably graphite foam having an open porous structure. Graphite foam is advantageous because graphite foam has high thermal conductivity, a mass that is significantly less than metal foam materials, and has advantageous physical properties, such as being able to absorb vibrations (e.g. sound). Graphite foam can be configured in a wide range of geometries based on application needs and/or heat transfer requirements. Graphite foam can be used in exemplary applications such as power electronics cooling, transpiration, evaporative cooling, radiators, space radiators, EMI shielding, thermal and acoustic signature management, and battery cooling.

Figure 6A:
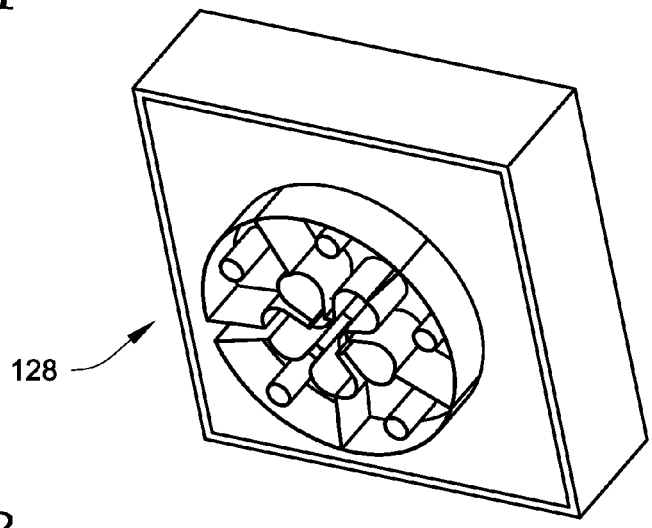
Figure 6B:
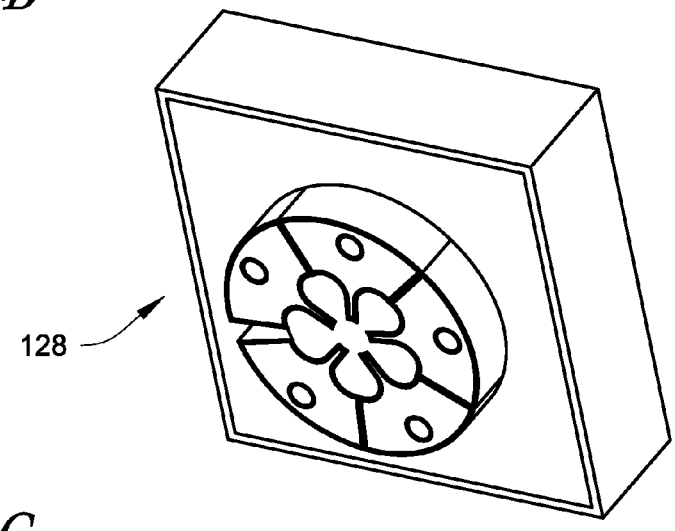
Figure 6C:
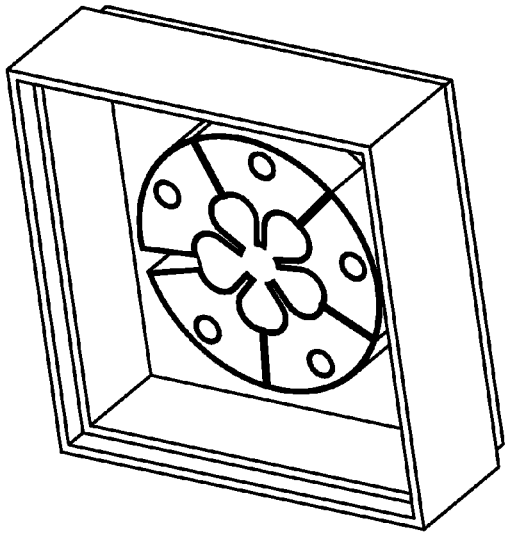
Figure 6D:
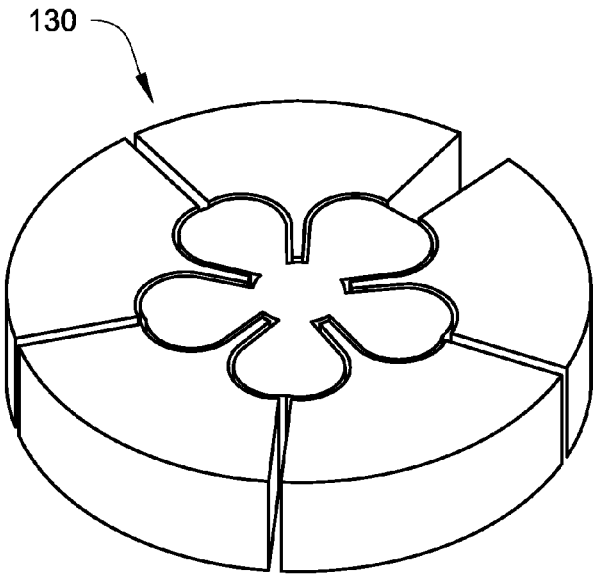
Figure 6E:
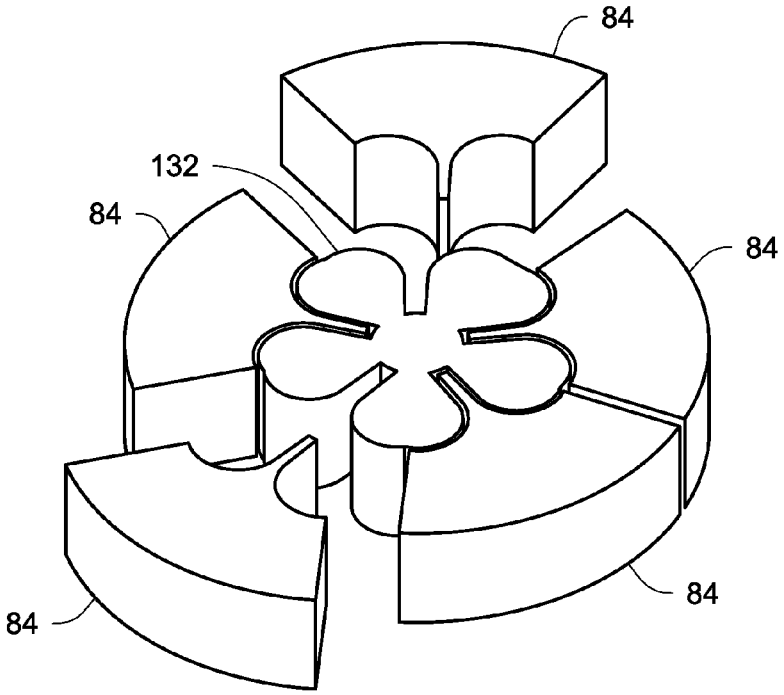

FIGS. 6A-E depict an exemplary process of how the heat transfer units 82 can be made. It is to be realized that this process is exemplary only and that other processes can be used. The heat transfer units 82 can be made by a process that stamps a foam material into a plurality of the wedge-shaped bodies 84. FIG. 6A shows a die 128 for simultaneously punching a plurality of the bodies 84 from a circular foam substrate 130 (FIG. 6D). In FIG. 6B, the foam substrate is shown as stamped by the die. FIG. 6C shows the stamped material being pulled up and transitioned with the press to force the foam from the die. FIGS. 6D and 6E show the foam pressed out of the die 128, creating a plurality of the wedge-shaped bodies 84. In the illustrated example, five wedge-shaped bodies 84 are formed with each stamping sequence. However, a smaller or larger number of bodies 84 can be formed if desired. A clover-leaf shaped remainder 132 is left at the center of the substrate 130 which can be discarded.

FIGS. 6D and 6E show the bodies 84 without the holes 90. The holes 90 could be formed directly by the die 128. Alternatively, if the die does not form the holes, the holes can be created in the bodies 84 after the stamping process through a separate machining process.

FIG. 7 shows another embodiment of a foam heat transfer unit 150 disposed on a tube 64 of a tube bundle of a shell-and-tube heat exchanger. The heat transfer unit 150 comprises a generally cylindrical body with a central passage through which the tube 64 extends. The heat transfer unit 150 is in thermal contact with, directly or indirectly, the outer surface of the tube 64. The body of the heat transfer unit 150 includes opposite end surfaces 152 that form heat transfer surfaces extending substantially radially from the outer surface of the tube. The heat transfer unit 150 can be fixed on the tube to maintain the axial position thereof in any suitable manner, for example by a friction fit or by using an adhesive. Axially extending channels 154 are formed in the body that extend between the end surfaces 152. The channels 154 are evenly circumferentially spaced from one another around the body. In the illustrated embodiment, four channels 154 are shown, although a smaller or larger number of channels 154 can be used.

In FIG. 7, a pair of the heat transfer units 150 are shown disposed on the tube 64, spaced from each other with an axial gap between the heat transfer units. The two heat transfer units are rotated, for example, approximately 45 degrees relative to each other. However, the rotational angle between the heat transfer units can be more or less than 45 degrees, with the angle chosen based on, for example, the number of grooves and the spacing of the heat transfer units on the tube 64.

As shown by the arrows in FIG. 7 representing the flow of fluid, a fluid flowing through the channel 154 impacts the surface of the adjacent heat transfer unit between the channels 154 causing the fluid to change direction in order to flow into the channels 154 of the adjacent heat transfer unit 150. Additional heat transfer units 150 can be disposed along the entire length of the tube 64, spaced from each other and rotated relative to a preceding heat transfer unit, similar to that shown in FIG. 7.

FIG. 8 shows an embodiment of a foam heat transfer unit 160 disposed around the tube 64 of a tube bundle of a shell-and-tube heat exchanger. The heat transfer unit 160 is configured as a cylindrical sleeve with at least one end surface 162 that forms a heat transfer surface extending substantially radially from the outer surface of the tube. The heat transfer unit 160 can extend along any length of the tube, and preferably extends along substantially the entire length of the tube. The heat transfer unit 160 can be fixed on the tube to maintain the axial position thereof in any suitable manner, for example by a friction fit or by using an adhesive. In another embodiment, the heat transfer unit 160 is formed by two or more semi-circular sections that are fixed to the outer surface of the tube to form a sleeve. In addition, the sections can be spaced from one another to form one or more grooves between the sections that extend along the axis of the tube 64.

With each of the heat transfer units 150, 160, they can be used by themselves, with each other, or with the heat transfer units 82. In addition, when the heat transfer units 150, 160 are mounted on the tubes 64, the outer surfaces of the heat transfer units 150, 160 preferably are in thermal contact with, directly or indirectly, the outer surfaces of the heat transfer units 150, 160 of one or more adjacent tubes 64.

FIG. 9 shows an embodiment of a portion of a tube bundle 170 of a shell-and-tube heat exchanger with a plurality of tubes 172 similar in function to the tubes 64. A plurality of identical foam heat transfer units 174 are illustrated as being engaged with the tubes 172 and spaced along the length of the tubes. The heat transfer units 174 have bodies that are constructed as cradles or frames so that each heat transfer unit 174 is configured to engage with a plurality of the tubes 172. In particular, the body of each heat transfer unit 174 is formed with a pair of outer tube contact surfaces 176*a*, 176*b* and three inner tube contact surfaces 178*a*, 178*b*, 178*c*. However, the heat transfer units 174 can be configured to engage with more or less tubes as well. Each heat transfer unit 174 also includes generally planar end surfaces that form heat transfer surfaces extending substantially radially from the outer surface of the tubes.

FIG. 9 shows a first set of the heat transfer units on one side of the tubes 172 with the outer contact surfaces 176*a*, 176*b* facing upward, and a second set of the heat transfer units on the opposite side of the tubes 172 with the outer contact surfaces 176*a*, 176*b* facing downward. The first set of heat transfer units is axially or longitudinally offset from the heat transfer units of the second set. In the embodiment illustrated in FIG. 9, seven tubes 172 can be engaged with the heat transfer units 174, including two tubes engaged with the tube contact surfaces 176*a*, 176*b* of the upper set, two tubes engaged with the tube contact surfaces 176*a*, 176*b* of the lower set, and three tubes engaged with the inner tube contact surfaces 178*a*, 178*b*, 178*c* of the upper and lower set. It is to be realized that the heat transfer units 174 can be configured to engage with a larger or smaller number of tubes.

Figure 17A:
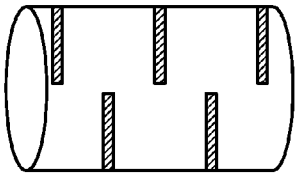
Figure 17B:
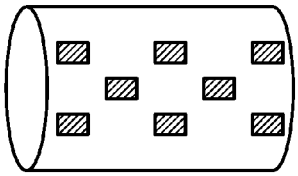
Figure 17C:
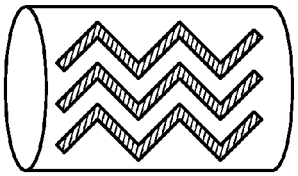
Figure 17D:
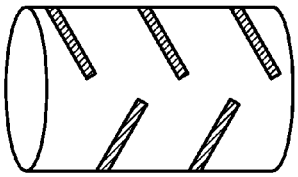
Figure 17E:
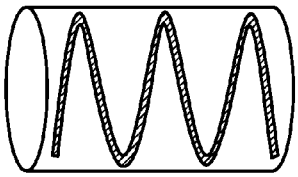
Figure 17F:
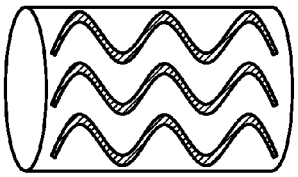

Depending upon the layout of the heat transfer units 174, the heat transfer units can create offsets, spirals or other flow patterns, in either counter, co-current or cross-flow arrangements. FIGS. 17A-F illustrate examples of patterns formed by different configurations of the foam heat transfer units 174 from FIG. 9. For example, as shown in FIG. 17A, the heat transfer units can be arranged into a baffled "offset" configuration. FIG. 17B shows the heat transfer units arranged disposed in an offset configuration. When viewed from the top, each of the heat transfer units may have the shape of, but not limited to, square, rectangular, circular, elliptical, triangular, diamond, or any combination thereof. FIG. 17C shows the heat transfer units arranged into a triangular-wave configuration. Other types of wave configurations, such as for example, square waves, sinusoidal waves, sawtooth waves, and/or combinations thereof are also possible. FIG. 17D shows the heat transfer units arranged into an offset chevron configuration. FIG. 17E shows the heat transfer units arranged into a large helical spiral. FIG. 17F shows the heat transfer units arranged into a wavy arrangement or individual helical spirals.

FIG. 10A shows another embodiment of a tube bundle that has a plurality of tubes 190 arranged with an equilateral triangular pitch (i.e. the space between the tubes is generally an equilateral triangle). FIG. 10B shows tubes 190 of a tube bundle arranged with a square pitch, while FIG. 10C shows tubes 190 of a tube bundle arranged with a staggered square pitch.

In FIGS. 10A-C, foam heat transfer units 192 are shaped to fit in the pitch space between the tubes. For example, as shown in FIG. 10A, foam heat transfer units 192 are disposed between the tubes 190 and have surfaces that are in thermal contact with the tubes. Each of the heat transfer units 192 comprises a generally triangular body, that can be radiused to the curvature of the tubes, with a generally triangular cross-section, and with the three surfaces of the triangular body in thermal contact with, directly or indirectly, three separate tubes 190.

The heat transfer units 192 may be arranged as required for heat transfer efficiency and/or providing directional flow of the fluid outside the tubes 190. For example, the heat transfer units 192 can be arranged in any configuration to mimic a helix, multiple helix, offset baffle, offset blocks, or other patterns as shown in FIGS. 17A-F.

A person of ordinary skill in the art would realize that the tubes can be arranged with other pitch shapes between the tubes, and that the foam heat transfer units can have other corresponding shapes as well.

With reference to FIGS. 11 and 12, another embodiment of a shell-and-tube heat exchanger 200 is illustrated that employs a tube bundle that includes twisted tubes 202 together with a foam heat transfer unit 204. This embodiment has a number of advantages, including strengthening the tube core, eliminating the need for baffles, minimizing vibrations, and enhancing heat transfer on both the tube side (i.e. on the helical tubes) and on the shell side (the foam heat transfer unit).

The heat exchanger 200 includes a shell 206 that has axial inlets and outlets at each end for a first fluid to flow into and out of the tubes 202. Tubes sheets, similar to the tube sheets 68, 72 would be provided at each end of the tube bundle, would be attached to each tube 202, and would fit within and close off the ends of the shell 206. The shell also includes a radial inlet 208 and a radial outlet 210 for a second fluid.

In this embodiment, the tubes 202 are twisted helically around the foam heat transfer unit 204 along the length of the heat transfer unit 204. The heat transfer unit 204 comprises a central, solid body of foam such that at any cross-section of the tube bundle, the foam body forms a heat transfer surface extending substantially radially from the outer surface of the tube(s). In FIG. 11, the heat transfer unit 204 is represented by the dashed line extending the length of the shell 206. The dashed line is not intended to imply that the heat transfer unit 204 is broken into sections or is discontinuous (although it is possible that the heat transfer unit 204 could be broken into separate section or made discontinuous if desired). The helical arrangement of tubes 202 enhances heat flow between the fluid flowing in the tubes and the fluid flowing in the shell outside of the tubes, by breaking up boundary layers inside and/or outside the tubes and combining axial and radial flow of the fluid along and around the outer surface of the tubes. In addition, the use of a baffle can be eliminated if desired. Further, the tubes 202 could be twisted about their own axes as well.

Although FIGS. 11 and 12 show six tubes 202, a smaller or larger number of tubes can be used. For example, as discussed further below with respect to FIGS. 13-15, three tubes can be helically wound around a central, solid heat transfer unit.

FIG. 13 is a cross-sectional view of another embodiment of a tube bundle that contains many axial tubes 222 disposed in a shell 224. Two different implementations of the twisted or helical tube concept are illustrated. The triangle 226 in FIG. 13 illustrates three tubes 228 helically twisted about a central, solid body foam heat transfer unit 230. This is illustrated more fully in FIG. 14 which additionally shows an optional sleeve 232 disposed around the assembly formed by the tubes 228 and the heat transfer unit 230 to form a tube-within-a-tube construction. The heat transfer unit 230 comprises a central, solid body of foam such that at any cross-section, the foam body forms a heat transfer surface extending substantially radially from the outer surface of the tube(s). In FIG. 14, the heat transfer unit 230 is represented by the dashed line extending the length of the sleeve 232. The dashed line is not intended to imply that the heat transfer unit 230 is broken into sections or is discontinuous (although it is possible that the heat transfer unit 230 could be broken into separate section or made discontinuous if desired).

Returning to FIG. 13, a hexagonal arrangement 240 of the twisted tube concept is illustrated and shown more fully in FIG. 15. In the hexagonal arrangement 240, a tube within a tube concept is provided similar to the single arrangement shown in FIG. 14, wherein a hexagonal pattern of six tubes-within-tubes assemblies 242 are used. Each assembly 242 includes a plurality of tubes 244, for example three tubes, helically twisted about a central, solid body foam heat transfer unit 246, with the tubes 244 and the heat transfer unit 246 disposed within a larger fluid carrying tube 248. So the first fluid flows within the tubes 244 as well as within the tubes 248 in contact with the outside surfaces of the tubes 244.

This twisted tube concept can be used by itself or in combination with any of the embodiments previously described herein. For example, FIG. 9 shows an arrangement similar to FIG. 14, with a plurality of the tubes 228 twisted helically around the heat transfer unit 230, and the tubes 228 and unit 230 disposed inside one of the tubes 172 to function together with the heat transfer units 174 at increasing the effectiveness of the heat exchanger.

The heat transfer units 204, 230 have been described above as being solid bodies. However, the heat transfer units 204, 230 need not be solid. Instead, the heat transfer units 204, 230 can function as fluid carrying fluid distribution tubes which would be useful for creating a baffle-less design in a spray evaporator. For example, with reference to FIG. 12, the heat transfer unit 204 can carry a fluid and be configured to spray the fluid outward as shown by the arrows onto the surfaces of the tubes 202. The sprayed fluid exchanges heat with the tube surfaces, causing some or all of the sprayed fluid to change phase into a vapor. Likewise, as illustrated by the arrows in FIGS. 13 and 14, the heat transfer unit 230 can be configured to spray fluid outward onto the tubes. One can also alternate foam and spray tubes too in various configurations.

FIG. 16 illustrates another embodiment of a shell-and-tube heat exchanger that uses rectangular blocks of foam heat transfer units 300 that are in thermal contact with, directly or indirectly, a plurality of axial tubes 302. The blocks would extend some or all of the axial length of the tubes 302. The blocks form a staggered diagonal baffle arrangement which is useful in applications where the second fluid flows in a cross-flow direction relative to the flow of the first fluid through the tubes 302. However, other heat transfer unit configurations and arrangements, as well as other flow patterns, are possible.

All of the shell-and-tube heat exchangers described herein operate as follows. A first fluid is introduced into one axial end of the tubes of the tube bundles, with the fluid flowing through the tubes to an outlet end where the first fluid exits the heat exchanger. The tubes can be single pass or multi-pass. Simultaneously, a second fluid is introduced into the shell. The second fluid can flow counter to the first fluid, in the same direction as the first fluid, or in a cross-flow direction relative to the flow direction of the first fluid. As the second fluid flows through the shell, it contacts the outer surfaces of the tubes and/or the surfaces of the heat transfer units. Because the first fluid flows within the tubes, separated from the second fluid, heat is exchanged between the first and second fluids.

Depending upon the application, the first fluid can be at a higher temperature than the second fluid, in which case heat is transferred from the first fluid to the second fluid via the tubes and the heat transfer units. Alternatively, the second fluid can be at a higher temperature than the first fluid, in which case heat is transferred from the second fluid to the first fluid via the tubes and the heat transfer units.

The first and second fluids can be either liquids, gases/vapor or a binary mixture thereof. One example of a first fluid is water, such as sea water, and one example of a second fluid is ammonia in liquid or vapor form, which can be used in an Ocean Thermal Energy Conversion system.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A shell-and-tube heat exchanger, comprising:

a shell defining an interior space, a first end, a second end, and an interior surface;

the shell including a first inlet for a first fluid, a first outlet for the first fluid, a second inlet for a second fluid, and a second outlet for the second fluid;

a tube bundle disposed in the interior space of the shell, the tube bundle including:

a plurality of tubes;

a first tube sheet fixed to first ends of the plurality of tubes, the first tube sheet is fixed to the shell adjacent to the first end thereof;

a second tube sheet fixed to second ends of the plurality of tubes, the second tube sheet is fixed to the shell adjacent to the second end thereof;

the plurality of tubes are in fluid communication with the first inlet and the first outlet so that the first fluid can flow into and through the plurality of tubes;

the second inlet and the second outlet are in fluid communication with a space defined between the first tube sheet and the second tube sheet so that the second fluid can flow into and through the space between the first tube sheet and the second tube sheet;

a helical baffle assembly connected to the plurality of tubes, the helical baffle assembly includes a plurality of wedge-shaped bodies formed of graphite foam;

each wedge-shaped body includes an arcuate radially outer edge that is in contact with the interior surface of the shell, first and second radiused tube contact surfaces positioned opposite the arcuate radially outer edge and each in contact with an outer surface of a respective one tube of the plurality of tubes, a first linear side edge extending from the arcuate radially outer edge to the first radiused tube contact surface, and a second linear side edge extending from the arcuate radially outer edge to the second radiused tube contact surface;

each wedge-shaped body is overlapped and in contact with an adjacent one of the wedge-shaped bodies over an overlap region, and each overlap region extends from the arcuate radially outer edge to the respective first and second radiused tube contact surfaces.

2. The heat exchanger according to claim 1, wherein central axes of the tubes of the plurality of tubes are parallel to each other.

3. The heat exchanger according to claim 1, wherein the wedge-shaped bodies are bonded to outer surfaces of the tubes of the plurality of tubes with a thermally conductive adhesive.

4. The heat exchanger according to claim 3, comprising conductive ligaments disposed within the thermally conductive adhesive, the conductive ligaments being in intimate contact with the outer surfaces.

5. The heat exchanger according to claim 1, further comprising a metal plate secured to each one of the wedge-shaped bodies.

6. The heat exchanger according to claim 2, wherein each of the wedge-shaped bodies includes a hole or slot that penetrates therethrough, and further comprising a support rod extending through the hole or slot, an axis of the support rod is parallel to the central axes of the tubes.

7. The heat exchanger according to claim 6, further comprising:

the first ends of the tubes are joined to the first tube sheet in a manner to prevent fluid leakage between the first ends and the first tube sheet and the second ends of the tubes are joined to the second tube sheet in a manner to prevent fluid leakage between the second ends and the second tube sheet; and the support rod has a first end joined to the first tube sheet in a manner to prevent fluid leakage between the first end thereof and the first tube sheet.

8. The heat exchanger according to claim 7, wherein the support rod includes a second end that is joined to the second tube sheet in a manner to prevent fluid leakage between the second end thereof and the second tube sheet.

9. The heat exchanger according to claim 7, wherein the first end and the second end of each tube are joined to the first tube sheet and the second tube sheet respectively by friction-stir welded joints, and the first end of the support rod is joined to the first tube sheet by a friction-stir welded joint.

10. The heat exchanger according to claim 1, wherein each wedge-shaped body consists of graphite foam.

* * * * *